US007895770B2

(12) United States Patent
Bae et al.

(10) Patent No.: US 7,895,770 B2
(45) Date of Patent: Mar. 1, 2011

(54) LAUNDRY MACHINE

(75) Inventors: Sang Hun Bae, Changwon-si (KR); Chang Woo Son, Changwon-si (KR); Chul Jin Choi, Changwon-si (KR); Dong Hyun Kim, Changwon-si (KR); Young Bok Son, Changwon-si (KR); Heung Jae Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 536 days.

(21) Appl. No.: 11/979,366

(22) Filed: Nov. 1, 2007

(65) Prior Publication Data

US 2008/0141558 A1 Jun. 19, 2008

(30) Foreign Application Priority Data

Dec. 15, 2006 (KR) ..... 10-2006-0128475
Dec. 18, 2006 (KR) ..... 10-2006-0129481

(51) Int. Cl.
*F26B 19/00* (2006.01)

(52) U.S. Cl. ..... 34/595; 34/60; 34/90

(58) Field of Classification Search ..... 34/132, 34/595, 60, 90
See application file for complete search history.

(56) References Cited

U.S. PATENT DOCUMENTS

| | | | | |
|---|---|---|---|---|
| 5,080,087 | A * | 1/1992 | McFadden et al. | 126/21 A |
| 5,337,703 | A * | 8/1994 | Schlesch et al. | 122/379 |
| 2005/0034489 | A1 | 2/2005 | Oh et al. | |
| 2006/0277690 | A1 * | 12/2006 | Pyo et al. | 8/149.2 |

FOREIGN PATENT DOCUMENTS

| | | | |
|---|---|---|---|
| DE | 2404727 | A1 | 2/1974 |
| EP | 1464750 | A1 | 10/2004 |
| EP | 1507029 | A | 2/2005 |
| WO | WO 2006/126803 | A | 11/2006 |

* cited by examiner

*Primary Examiner* — Jiping Lu
(74) *Attorney, Agent, or Firm* — McKenna Long & Aldridge LLP

(57) ABSTRACT

A steam laundry dryer is disclosed. The steam laundry dryer includes a drum rotatably mounted in a cabinet, a hot air heater to heat air to supply hot air into the drum, a steam generator to supply steam into the drum, a water supply source to supply water into the steam generator, and a container drawably mounted in a portion of the cabinet. The water supply source is detachably mounted in the container.

29 Claims, 16 Drawing Sheets

LAUNDRY MACHINE

This application claims the benefit of Korean Patent Application Nos. 10-2006-0128475, filed on Dec. 15, 2006 and 10-2006-0129481, filed on Dec. 18, 2006, which are hereby incorporated by reference in its entirety as if fully set forth herein.

BACKGROUND OF THE INVENTION

1. Field of the Invention

The present invention relates to a laundry machine, and more particularly, to a steam laundry dryer including a steam generator which can prevent wrinkles or static electricity of laundry.

2. Discussion of the Related Art

Laundry dryers are typically electric appliances that dry washed laundry, mainly washed clothes, by using high temperature air. In general, a laundry dryer is configured of a drum, a driving source, heating means and a blower unit. Laundry is held in the drum, and the driving source drives the drum. The heating means heats air drawn into the drum. The blower unit sucks air into the drum, or discharges air outside the drum.

Laundry dryers may be categorized, based on a method of heating air, i.e., heating means, into electric type laundry dryers and gas type laundry dryers. In an electric type laundry dryer, air is heated by using electric resistance heat. In a gas type laundry dryer, air is heated by using heat generated from gas combustion. On the other hand, laundry dryers may be categorized into condensation type laundry dryers and exhaustion type laundry dryers. In a condensation type laundry dryer, air is heat-exchanged with laundry in the drum and the damp air is circulated without being discharged outside the laundry dryer, to be heat-exchanged with external air at an auxiliary condenser. At this time, condensed water is generated and discharged outside. In an exhaustion type laundry dryer, air is heat-exchanged with laundry in the drum and the damp air is directly discharged outside the laundry dryer. Further, laundry dryers may be categorized, based on a method of loading laundry, into top loading type laundry dryers and front loading type laundry dryers. In a top loading type laundry dryer, laundry is loaded into the drum through a top of the laundry dryer. In a front loading type laundry dryer, laundry is loaded into the drum through a front of the laundry dryer.

However, the above conventional laundry dryers have the following problems.

Commonly, the washed and dehydrated laundry is loaded and dried in the laundry dryer. In view of a principle of water washing, the washed laundry has wrinkles, and the wrinkles are not removed during a drying process in the laundry dryer. As a result, the conventional laundry dryer has a shortcoming that a user should iron out the dried laundry to remove the wrinkles.

Moreover, in case that clothes besides the washed laundry are kept and used, the clothes may have wrinkles, crumples and fold marks (hereinafter, commonly referred to as "wrinkles"). Accordingly, there have been demands for development of devices capable of also easily removing the wrinkles generated by the common usage and keeping of the clothes.

SUMMARY OF THE INVENTION

Accordingly, the present invention is directed to a steam laundry dryer that substantially obviates one or more problems due to limitations and disadvantages of the related art.

An object of the present invention is to provide a steam laundry dryer that can prevent and/or remove wrinkles of laundry.

Another object of the present invention is to provide a steam laundry dryer that can facilitate mounting and demounting of a cartridge supplying water to a steam generator.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a steam laundry dryer comprises: a drum rotatably mounted in a cabinet; a hot air heater to heat air to supply hot air into the drum; a steam generator to supply steam into the drum; a water supply source to supply water into the steam generator; and a container drawably mounted in a portion of the cabinet, the water supply source being detachably mounted in the container.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIG. 10 is viewed from the front;

DETAILED DESCRIPTION OF THE INVENTION

Reference will now be made in detail to the preferred embodiments of the present invention associated with a steam laundry dryer, examples of which are illustrated in the accompanying drawings. Wherever possible, the same reference numbers will be used throughout the drawings to refer to the same or like parts. For convenience of explanation of a steam laundry dryer according to the present invention, a top loading type, electric type and condensation type laundry dryer will be exemplified. However, the present invention is not limited to the above example, and also can be applied to a front loading type, gas type and condensation type laundry dryer.

Figure 1:
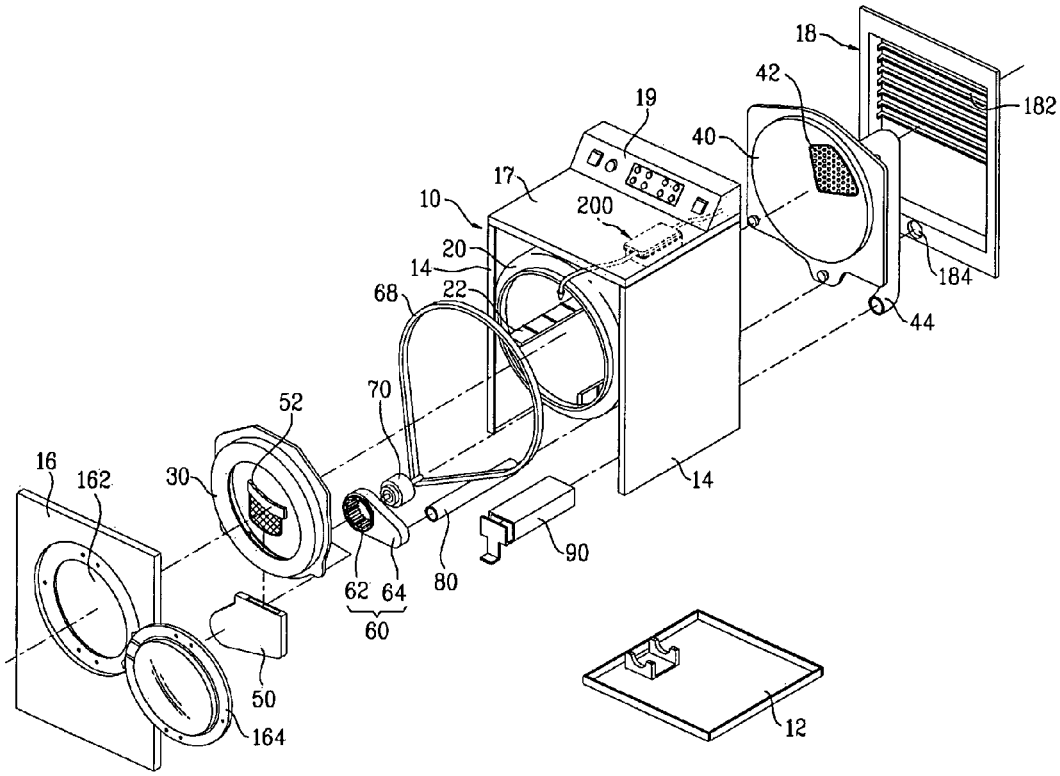
FIG. 1 is an exploded perspective view illustrating a steam laundry dryer in accordance with an exemplary embodiment of the present invention.
Figure 2:
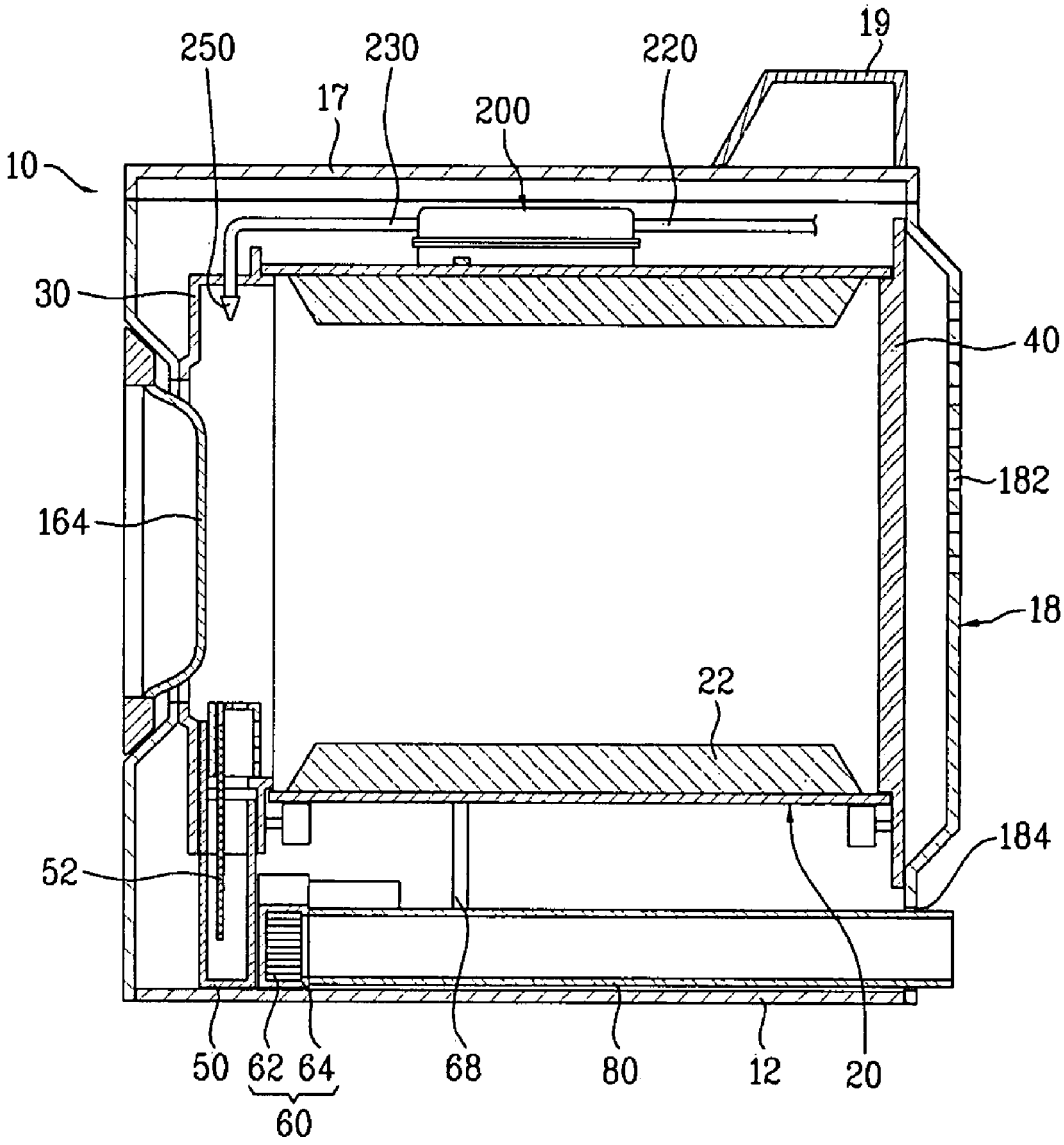
FIG. 2 is a longitudinal-sectional view of FIG. 1.

FIG. 1 is an exploded perspective view illustrating a steam laundry dryer in accordance with an exemplary embodiment of the present invention, and FIG. 2 is a longitudinal-sectional view of FIG. 1.

A steam laundry dryer according to an exemplary embodiment of the present invention will now be described with reference to FIGS. 1 and 2.

A cabinet 10 defines an exterior appearance of the steam laundry dryer according to the present invention, and houses components described below. Inside the cabinet 10 are mounted a rotatable drum 20, and a motor 70 and a belt 68 to drive the drum 20. A heater 90 (hereinafter, referred to as "hot air heater") is mounted in a predetermined portion of the cabinet 10 to create air of a high temperature (hereinafter, referred to as "hot air") by heating the air. A hot air supply duct 44 is mounted in a predetermined portion of the cabinet 10 to supply the hot air generated from the hot air heater 90 into the drum 20. Also, there are provided an exhaustion duct 80 and a blower unit 60 in the cabinet 10. The damp air heat-exchanged with the laundry in the drum 20 is discharged outside the drum 20 through the exhaustion duct 80, and the damp air is sucked by the blower unit 60. A steam generator 200 is mounted in a predetermined portion of the cabinet 10 to generate steam of a high temperature.

For convenience of explanation, this embodiment shows and describes an indirect drive type such that the drum 20 is rotated by the motor 70 and the belt 68, however the present invention is not limited thereto. In other words, the present invention also can be applied to a direct drive type such that the drum 20 is directly rotated by directly connecting the motor to a rear surface of the drum 20.

The aforesaid components will now be explained in detail.

The cabinet 10 defining the exterior appearance of the laundry dryer includes a base 12 forming a bottom surface, a pair of side covers 14 vertically mounted to the base 12, a front cover 16 mounted to front surfaces of the side covers 14, a rear cover 18 mounted to rear surfaces of the side covers 14, and a top cover 17 mounted to top surfaces of the side covers 14. A control panel 19 having various operational switches is positioned on the top cover 17 or the front cover 16, and a door 164 is coupled to the front cover 16. An air inlet 182 and an air outlet 184 are provided at the rear cover 18. External air is drawn through the air inlet 182, and the air in the drum 20 is discharged outside through the air outlet 184 that is a final path to the outside.

An inner space of the drum 20 is employed as a drying chamber for drying the laundry. It is preferred that a lifter 22 is installed in the drum 20 to lift and drop the laundry, so that the laundry is turned over to enhance drying efficiency.

A front supporter 30 and a rear supporter 40 are provided between the drum 20 and the cabinet 10. More particularly, the front supporter 30 is provided between the drum 20 and the front cover 16, and the rear supporter 40 is provided between the drum 20 and the rear cover 18. The drum 20 is rotatably mounted between the front supporter 30 and the rear supporter 40, and sealing members (not shown) for preventing water leakage are provided between the front supporter 30 and the drum 20 and between the drum 20 and the rear supporter 40. The front supporter 30 and the rear supporter 40 shield a front surface and a rear surface of the drum 20, respectively, to form the drying chamber and support a front end and a rear end of the drum 20.

An opening is formed at the front supporter 30 to communicate the drum 20 with the outside of the laundry dryer. The opening is selectively opened and closed by the door 164. A lint duct 50, through which the air in the drum 20 flows outside, is connected to the front supporter 30, and a lint filter 52 is installed at the lint duct 50.

A portion of the blower unit 60 is connected to the lint duct 50, and an opposite portion of the blower unit 60 is connected to the exhaustion duct 80. The exhaustion duct 80 is in communication with the air outlet 184 provided at the rear cover 18.

Accordingly, if the blower unit 60 operates, the air in the drum 20 flows through the lint duct 50, the exhaustion duct 80 and the air outlet 184 in order, and is discharged outside. At this time, foreign substances including lint are filtered by the lint filter 52. The blower unit 60 typically consists of a blower 62 and a blower housing 64. The blower 62 is commonly connected to the motor 70 for driving the drum 20.

An opening portion 42 including a plurality of through-holes is formed at the rear supporter 40, and the hot air supply duct 44 is connected to the opening portion 42. The hot air supply duct 44 is in communication with the drum 20, and is employed as a path for supplying hot air into the drum 20. For this, the hot air heater 90 is mounted in a predetermined portion of the hot air supply duct 44.

The steam generator 200 is mounted in a predetermined portion of the cabinet 10 to generate steam and supply the steam into the drum 20.

Figure 3:
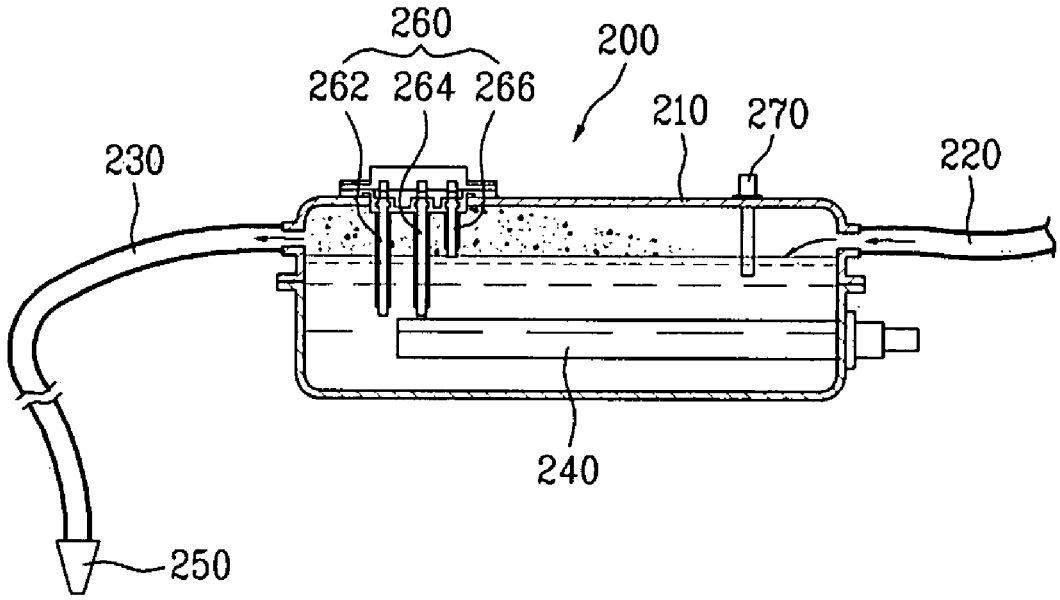
FIG. 3 is a sectional view illustrating a steam generator shown in FIG. 1.

FIG. 3 is a sectional view illustrating the steam generator shown in FIG. 1. The steam generator 200 will now be explained in detail with reference to FIG. 3.

The steam generator 200 includes a water tank 210 to store water therein, a heater 240 mounted in the water tank 210, a water level sensor 260 to detect a water level in the steam generator 200, and a temperature sensor 270 to detect a temperature of the steam generator 200. The water level sensor 260 includes a common electrode 262, a low water level electrode 264 and a high water level electrode 266. A high water level is sensed based on whether an electric current is applied between the common electrode 262 and the high water level electrode 266, and a low water level is sensed based on whether an electric current is applied between the common electrode 262 and the low water level electrode 264.

A water supply hose 220 is connected to a portion of the steam generator 200 to supply water, and a steam hose 230 is connected to an opposite portion of the steam generator 200 to discharge steam. It is preferred that a nozzle 250 having a predetermined shape is provided at a front end of the steam hose 230. An end of the water supply hose 220 is typically connected to an external water supply source such as a water tap. The front end of the steam hose 230 or the nozzle 250, that is, a steam outlet is positioned at a predetermined portion of the drum 20 to spray steam into the drum 20.

Although this embodiment shows and describes the steam generator 200 in which the heater 240 heats the water in the water tank 210 to generate steam (hereinafter, referred to as "tank heating type steam generator" for convenience of explanation), the present invention is not limited thereto. In other words, any device capable of generating steam may be used as the steam generator in the present invention. For example, a steam generator in which a heater is directly installed around a water supply hose to heat the water flowing through the water supply hose, without storing water in a predetermined space, (hereinafter, referred to as "pipe heating type steam generator" for convenience of explanation) may be applicable to the present invention.

Figure 4:
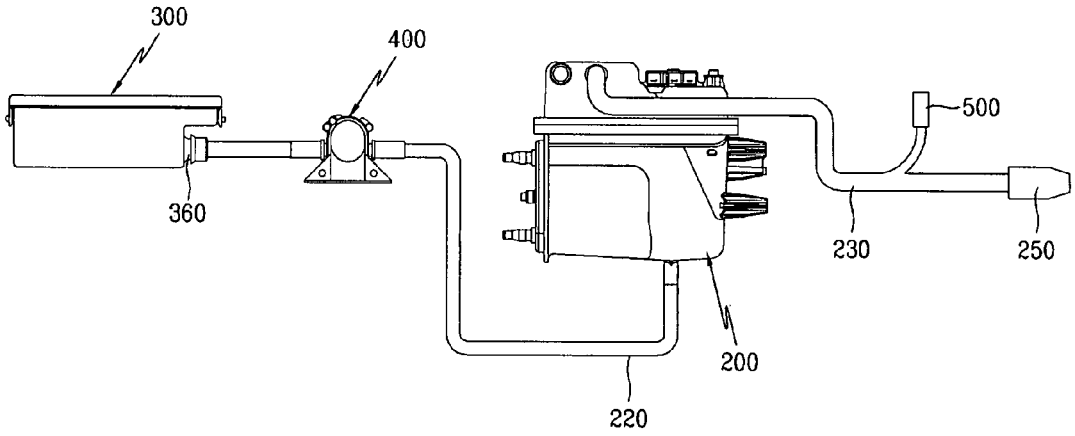
FIG. 4 is a schematic view illustrating a steam generator of a steam laundry dryer in accordance with another exemplary embodiment of the present invention.

FIG. 4 is a schematic view illustrating a steam generator of a steam laundry dryer in accordance with another exemplary embodiment of the present invention. A steam laundry dryer according to another embodiment of the present invention will now be described with reference to FIG. 4.

In this embodiment, a water supply source for supplying water to the steam generator 200 is detachably mounted. The water supply source may be configured as a water tap as described in the previous embodiment. However, in such a case, the installation becomes complicated. This is because the laundry dryer does not commonly use water, if the water tap is used as the water supply source, various devices annexed thereto should be additionally installed. Accordingly, this embodiment using a detachable water supply source 300 is very convenient in use. In other words, the water supply source 300 is detached from the laundry dryer to be filled with water, and then the water supply source 300 filled with water is connected to a water supply passage of the steam generator 200, i.e., the water supply hose 220.

It is preferred that a pump 400 is provided between the water supply source 300 and the steam generator 200. More preferably, the pump 400 can rotate in a forward direction and a reverse direction, so as to supply water into the steam generator 200 or collect residual water in the steam generator 200 as needed.

It also may be possible to supply water into the steam generator 200 by using a difference in water column heights between the water supply source 300 and the steam generator 200, without using the pump 400. However, because the components of the steam laundry dryer are typically standardized and designed compactly, a structural space is absolutely small. Therefore, if sizes of the components of the conventional laundry dryer are not changed, the water supply using the difference in water column heights is practically impossible. As a result, it is very useful to use the compact pump 400, because the steam generator 200 can be installed without changing sizes of the components of the conventional laundry dryer. Here, the reason for collecting residual water in the steam generator 200 is that if the steam generator 200 is not used for a long period, the heater may be damaged by the residual water or rotten water may be used in the following operation.

While the previous embodiment is configured such that the water supply and the steam exhaustion are achieved through the upper portion of the steam generator 200, this embodiment is configured such that water is supplied through the lower portion of the steam generator 200 and steam is exhausted through the upper portion of the steam generator 200. Such a configuration of this embodiment is effective to collect residual water in the steam generator 200. Also, it is preferred that a safety valve 500 is provided at a steam passage for discharging steam from the steam generator 200, i.e., the steam hose 230.

Hereinafter, the respective components will be explained in detail with reference to the drawings.

Figure 5:
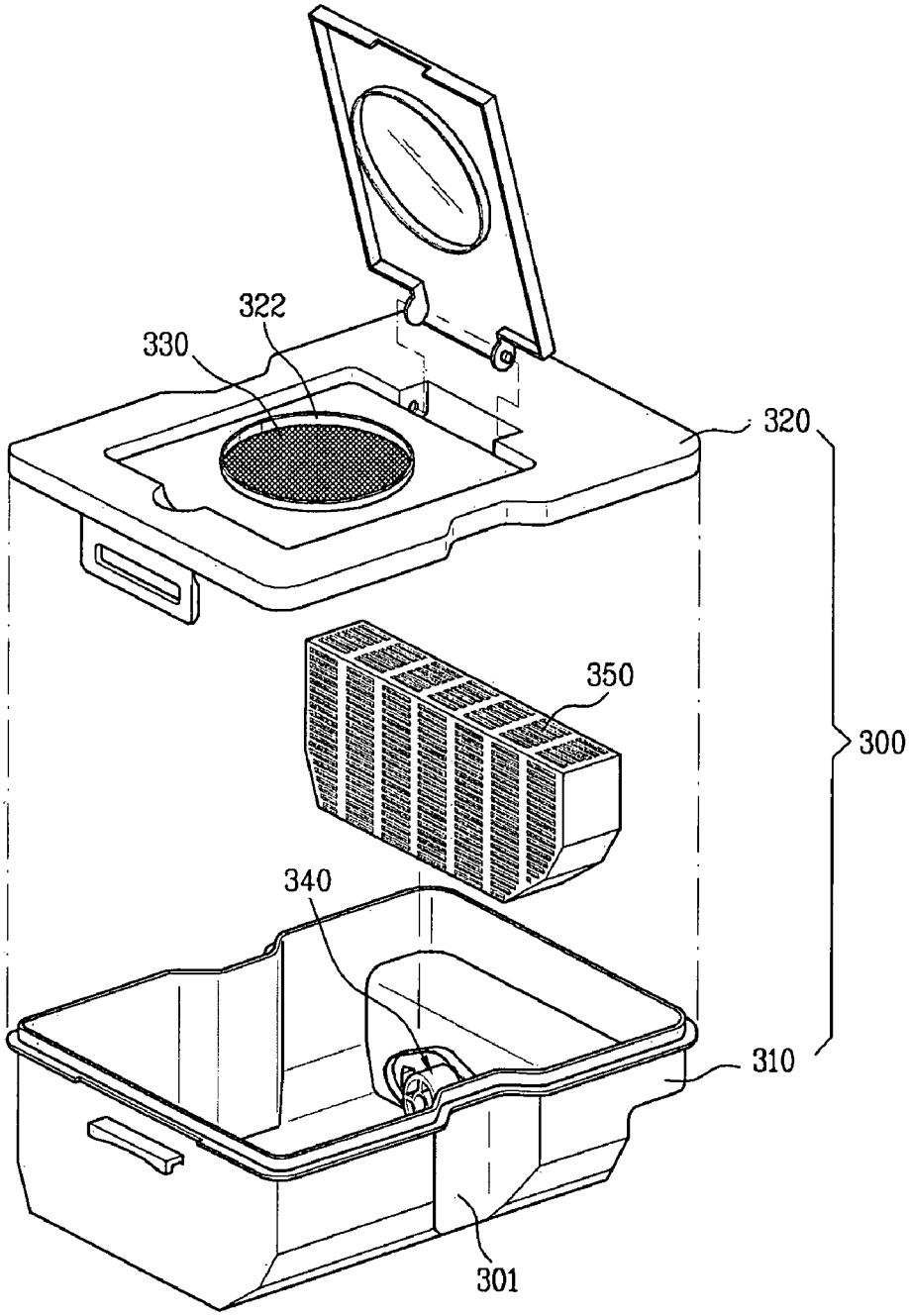
FIG. 5 is an exploded perspective view illustrating an example of a water supply source shown in FIG. 4.

First, the detachable water supply source 300 (hereinafter, referred to as "cartridge" for convenience of explanation) will be explained in detail with reference to FIG. 5.

The cartridge 300 includes a lower housing 310 to substantially store water therein, and an upper housing 320 detachably coupled to the lower housing 310. If the cartridge 300 is composed by the lower housing 310 and the upper housing 320, it is easy to clean out dirt of water in the cartridge 300 and to dismantle filters 330 and 340 and a water softening member 350 (which will be described later) to clean and reuse them.

It is preferred that a first filter 330 is mounted to the upper housing 320. In other words, the first filter 330 is mounted to a water inlet 322 of the upper housing 320, to firstly filter the water supplied into the cartridge 300.

An opening/closing member 360 (refer to FIG. 4) is provided at the lower housing 310 to selectively supply water in the cartridge 300 to the outside. When the cartridge 300 is detached, the opening/closing member 360 blocks the water from being discharged outside the cartridge 300. When the cartridge 300 is installed, the opening/closing member 360 permits the water to be discharged outside the cartridge 300. It is also preferred that a second filter 340 for filtering water is connected to the opening/closing member 360. It is more preferred that the second filter 340 is detachably provided.

By using the first filter 330 and the second filter 340, impurities, such as micro dust, contained in water can be filtered off twice. It is preferable to use the first filter 330 having about 50 mesh nets and the second filter 340 having about 60 mesh nets. Here, the 50 mesh nets refer to that the number of mesh per a predetermined area is 50. Accordingly, since a size of an air hole composing the mesh of the first filter 330 is larger than a size of an air hole composing the mesh of the second filter 340, the relatively large foreign substances are firstly filtered off by the first filter 330, and the relatively small foreign substances are secondarily filtered off by the second filter 340.

It is also preferred that a water softening member 350 for softening water is provided in the cartridge 300. It is more preferred that the water softening member 350 is detachably provided.

The reason for using the water softening member 350 is as follows. If hardness of water supplied into the steam generator 200 is high, when calcium hydrogen carbonate (Ca (HCO3)2) dissolved in water is heated, lime (calcium carbobate (CaCO3)) is educed, which may cause corrosion of the heater. Especially, such a phenomenon is accelerated in the European and American continents in which hard water having high hardness is used. Accordingly, it is preferable to prevent the eduction of the lime by using ion exchange resin to remove calcium and magnesium ions in advance. Because performance of the ion exchange resin is deteriorated as the water softening process is performed, the ion exchange resin is regenerated by salt (NaCl) and reused. The water softening process by the ion exchange resin is represented as follows: 2(R-SONa)+Ca2<->(R-SO)Ca+2Na. The regenerating process is represented as follows: (R-SO)Ca+2NaCl<->2(R-SONa)+CaCl.

Figure 6:
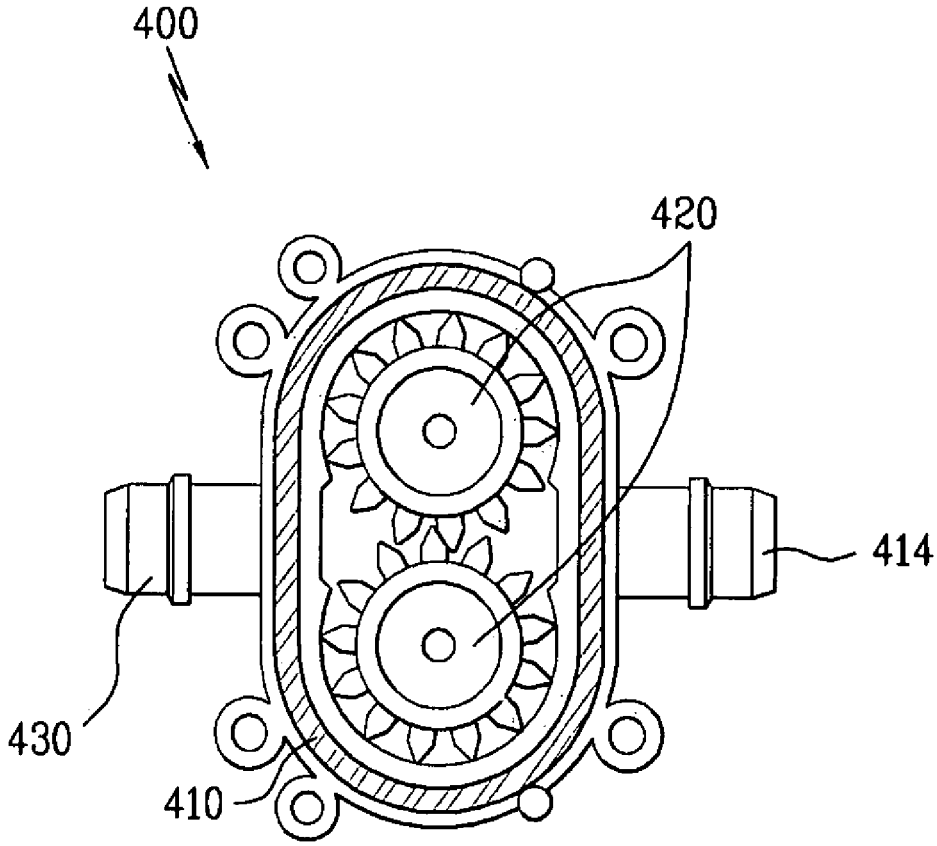
FIG. 6 is a sectional view schematically illustrating an example of a pump shown in FIG. 4.

FIG. 6 is a sectional view schematically illustrating an example of a pump according to the present invention.

Referring to FIG. 6, the pump 400 is employed to selectively supply water into the steam generator 200. It is preferred that the pump 400 can rotate in a forward direction and a reverse direction, so as to supply water into the steam generator 200 or collect water from the steam generator 200 as needed.

The pump 400 may be configured as a gear type pump, a pulsating type pump, or a diaphragm type pump. The pulsating type pump and the diaphragm type pump can control the flow of fluid in a forward direction and a reverse direction by changing polarities of a circuit momentarily as needed.

FIG. 6 illustrates a gear type pump as an example of the pump 400. The gear type pump 400 includes a case 410 and a pair of gears 420 provided in the case 410. The case 410 is provided with an inlet port 430 and an outlet port 414. According to a rotational direction of the gears 420, the water flows from the inlet port 430 to the outlet port 414 or from the outlet port 414 to the inlet port 430.

Figure 7:
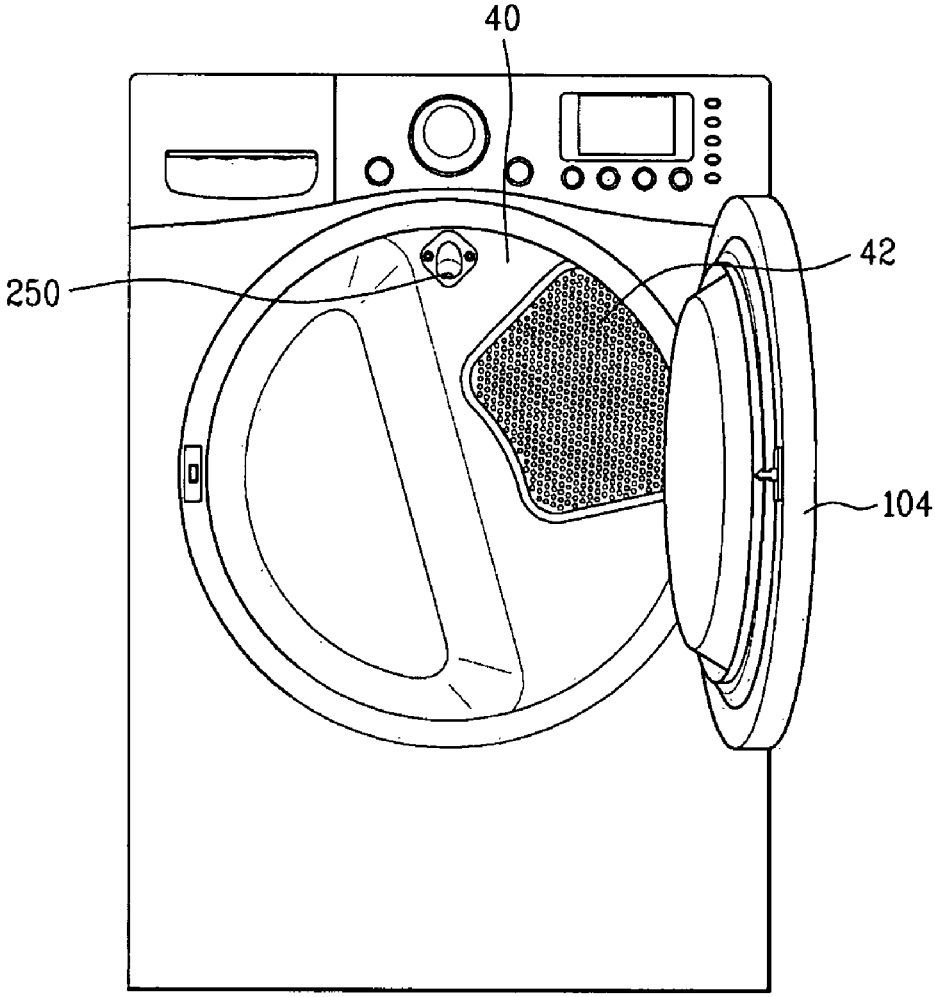
FIG. 7 is a front view illustrating a state of mounting a nozzle shown in FIG. 4.

FIG. 7 is a front view illustrating the steam laundry dryer mounted with the nozzle shown in FIG. 4.

Referring to FIG. 7, the nozzle 250 is mounted adjacent to the opening portion 42 for supplying hot air into the drum, so as to spray steam into the drum toward the front surface of the drum from the rear surface. The air is drawn into the drum through the opening portion 42 formed at the rear supporter 40 disposed at the rear of the drum, and then flows out to the lint duct 50 (refer to FIG. 1) provided under the door 104 disposed at the front of the drum. Accordingly, the air flow passage is defined substantially from the opening portion 42 to the lint duct 50. As a result, if the steam is sprayed toward the lower portion of the door 104 disposed at the front of the drum from the nozzle 250 mounted adjacent to the opening portion 42 disposed at the rear of the drum, the sprayed steam smoothly flows along the air flow passage, thereby evenly reaching the laundry in the drum.

The nozzle 250 explained in this embodiment can be applied to a laundry dryer without the detachable water supply source 300. For example, the nozzle 250 can be applied to a laundry dryer in which an external water tap is used as the water supply source 300.

The installation of the steam generator and other components of a steam line according to the present invention will now be explained with reference to FIG. 8.

A drawer type container 700 (hereinafter, referred to as "drawer") is drawably inserted into a portion of the cabinet 10 (refer to FIG. 1) forming the exterior appearance of the steam laundry dryer. Preferably, the cartridge 300 is detachably mounted in the drawer 700. In such a case, it is preferable to mount the cartridge 300 in the drawer 700 and to indirectly connect/disconnect the cartridge 300 to/from the pump 400 by inserting/drawing the drawer 700, rather than to directly connect the cartridge 300 to the pump 400.

It is preferred that the drawer 700 is provided at the front surface of the steam laundry dryer, e.g., the control panel 19. A supporter 820 is mounted at the rear of the control panel 19. Particularly, the supporter 820 is mounted substantially parallel with a top frame 830, and a drawer guide (or also referred to as "container guide") 710 is mounted to the supporter 820 and the top frame 830 to support the drawer 700 and guide the drawing and inserting of the drawer 700. Although it is not illustrated in the drawings, it is preferable to provide a top guide to cover an upper portion of the drawer guide 710. The drawer guide 710 will be explained in detail later.

The cartridge 300 is formed with concave portions 301 at both side surfaces. The cartridge 300 is mounted/demounted by using the concave portions 301.

Figure 9:
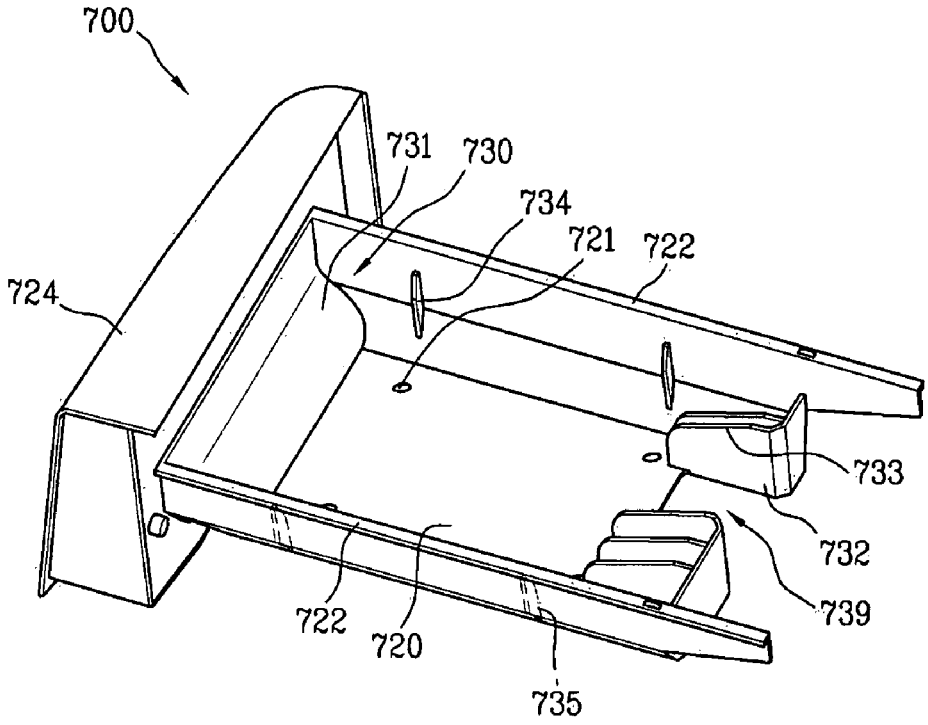
FIG. 9 is a perspective view illustrating an example of a container mounted with the water supply source.

It is preferable to provide a guide unit to guide the cartridge 300 to be located at a correct position in the drawer 700 when the cartridge 300 is mounted in the drawer 700. FIG. 9 is a perspective view illustrating the drawer 700 with the guide unit.

Referring to FIG. 9, the drawer 700 has an opened top surface, and has an inner space shaped corresponding to the cartridge 300 (refer to FIG. 8) mounted therein. Preferably, as shown in the drawing, the drawer 700 is formed substantially in a hexahedral shape having the opened top surface, corresponding to the hexahedral-shaped cartridge 300. In other words, the drawer 700 includes a base 720, and side walls 722 extending vertically from the base 720. The side walls 722 are formed along the edges of both side portions and a front portion of the base 720 (hereinafter, an end portion positioned at the direction of drawing the drawer 700 is defined as a front portion, and an opposite end portion is defined as a rear portion). A second guide part 732 (which will be described later) is formed at the rear portion of the drawer 700.

It is preferred that a cover part 724 is provided at the front portion of the drawer 700 to enable a user to easily grasp the drawer 700 when drawing or inserting the drawer 700.

As described above, the drawer 700 is provided with the guide unit to guide the cartridge 300 to be located at a correct position in the inner space of the drawer 700 when the cartridge 300 is mounted in the drawer 700. The guide unit includes a first guide part 730 and a second guide part 732 which are respectively formed inwardly at the front portion and the rear portion of the drawer 700. The first guide part 730 is configured as a protruding part which protrudes inwardly from the front side wall 722, and the second guide part 732 is configured as at least one guide member 732 formed at the rear portion of the drawer 700. As shown in the drawing, the guide member 732 composing the second guide part 732 is formed in a rib shape extending inwardly of the drawer 700, so as to guide the installation of the cartridge 300 and reinforce strength of the drawer 700.

It is preferred that a distance between the first guide part 730 and the second guide part 732 is set corresponding to a length of the cartridge 300 mounted in the drawer 700. As shown in FIG. 9, it is also preferred that the protruding part composing the first guide part 730 is formed such that an upper surface 731 is inclined downwardly and inwardly of the drawer 700. It is also preferred that the guide member composing the second guide part 732 is formed such that an upper surface 733 is inclined downwardly and inwardly of the drawer 700.

By the aforesaid first and second guide parts 730 and 732, when mounting the cartridge 300 filled with water in the drawer 700, a user can put the cartridge 300 on the correct position in the inner space of the drawer 700 although she/he does not put the cartridge 300 on the center portion of the base 720. For example, if the cartridge 300 is put near the front portion of the drawer 700, the front portion of the cartridge 300 slips by the inclination of the upper surface 731 of the first guide part 730 of the drawer 700, and thus the cartridge 300 is positioned in the inner space of the drawer 700, particularly, in the space between the protruding part 730 and the rib 732. Similarly, if the cartridge 300 is put near the rear portion of the drawer 700, the rear portion of the cartridge 300 slips by the inclination of the upper surface 733 of the second guide part 732, and thus the cartridge 300 is positioned in the space between the first guide part 730 and the second guide part 732.

Since the distance between the first guide part 730 and the second guide part 732 is set corresponding to the length of the cartridge 300 as described above, the first guide part 730 and the second guide part 732 perform a role of fixing the cartridge 300 so as not to rattle on the mounting position as well as guiding the movement of the cartridge 300 when mounting the same.

It is preferred that the second guide part 732 is not formed continuously at the rear portion of the drawer 700, but is formed to have an opening portion 739 at a predetermined position as shown in FIG. 9.

The opening portion 739 performs a role of connecting the cartridge 300 and the pump 400 (refer to FIG. 4). Particularly, when the cartridge 300 is mounted in the drawer 700, the opening/closing member 360 (refer to FIG. 4) of the cartridge 300 protrudes outside the drawer 700 through the opening portion 739. Accordingly, when a user inserts the drawer 700 into the laundry dryer, the opening/closing member 360 protruding outside the drawer 700 is connected to the pump 400, and thus the water in the cartridge 300 is supplied into the steam generator 200 via the pump 400.

The drawer 700 of this embodiment may be further provided with a guide unit to guide the movement of the cartridge 300 by being selectively contacted with the side surfaces of the cartridge 300.

As shown in FIG. 9, the guide unit of the present invention further includes a third guide part 734 and a fourth guide part 735 which are formed at both inner side surfaces of the drawer 700, besides the first guide part 730 and the second guide part 732. The third and fourth guide parts 734 and 735 are configured as guide members which are protrudingly formed at both the inner surfaces of the drawer 700. Similarly to the second guide member 732, it is preferred that each of the third and fourth guide parts 734 and 735 is formed in a rib shape.

Similarly to the second guide part 732, it is also preferred that the third and fourth guide parts 734 and 735 are formed such that upper surfaces are inclined downwardly and inwardly of the drawer 700. Accordingly, when the cartridge 300 is mounted in the drawer 700, the cartridge 300 slips by the inclination of the upper surfaces of the third and fourth guide parts 734 and 735, and is positioned in the inner space of the drawer 700, in the same manner as the first and second guide parts 730 and 732. A distance between the third guide part 734 and the fourth guide part 735 is set corresponding to a width of the cartridge 300. Accordingly, when the cartridge 300 is mounted in the drawer 700, the third and fourth guide parts 734 and 735 fix the cartridge 300 to prevent the rattling of the cartridge 300 in both the side directions.

It is preferred that the drawer 700 of this embodiment is further provided with a position determining unit to determine the position of the cartridge 300 mounted in the drawer 700. The cartridge 300 mounted in the drawer 700 is put on the correct position of the center portion in the drawer 700 by the position determining unit.

Particularly, the position determining unit includes a coupling recess 721 formed at a predetermined portion of the base 720 of the drawer 700, and a coupling protrusion (not shown) formed at the lower surface of the cartridge 300 correspondingly to the coupling recess 721. The coupling protrusion and the coupling recess 721 perform a role of determining the position of the cartridge 300. In other words, when the cartridge 300 is mounted in the drawer 700 such that the coupling protrusion formed at the lower surface of the cartridge 300 is inserted into the coupling recess 721 of the drawer 700, a user can perceive that the cartridge 300 is located at the correct position.

The aforesaid guide unit for guiding the movement of the cartridge 300, also performs a role of fixing the cartridge 300 to a certain degree. However, the main role of the guide unit is to guide the movement of the cartridge 300, and the effect of fixing the cartridge 300 is practically insufficient.

Accordingly, it is preferred that the steam laundry dryer of the present invention is provided with a fixing member to fix the cartridge.

The reason for providing the fixing member will be explained in detail as follows.

Figure 8:
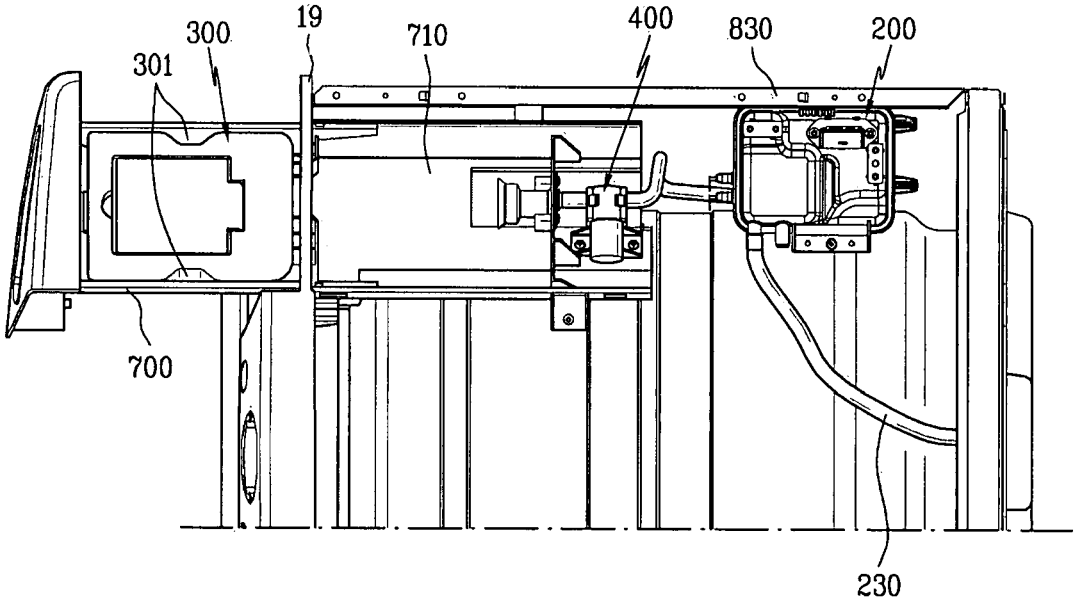
FIG. 8 is a perspective view illustrating a state of mounting components shown in FIG. 4.

As shown in FIG. 8, since the cartridge 300 is detachably mounted in the drawer 700, a gap is formed between the outer surface of the cartridge 300 and the inner surface of the drawer 700. If the cartridge 300 is not fixed due to the gap, vibration and noise may be generated due to the contact between the cartridge 300 and the drawer 700 during the operation of the steam laundry dryer. In other words, when the steam laundry dryer operates, the vibration generated from the motor 70 (refer to FIG. 1) is transferred to the drawer 700 via the cabinet 10 (refer to FIG. 1). At this time, if the cartridge 300 is not fixed to the drawer 700, the cartridge 300 is contacted with the drawer 700, thereby generating vibration and rattling noise. Further, when mounting the cartridge 300 in the drawer 700, a user may feel that the cartridge 300 is loosely mounted in the drawer 700 due to the gap.

To this end, the steam laundry dryer of the present invention further includes the fixing member to fix the cartridge 300 in the drawer 700 when mounting the cartridge 300 in the drawer 700. Preferably, the fixing member also performs a role of absorbing the vibration transferred from the drawer 700. The fixing member will now be explained in detail with reference to the drawings.

Figure 10:
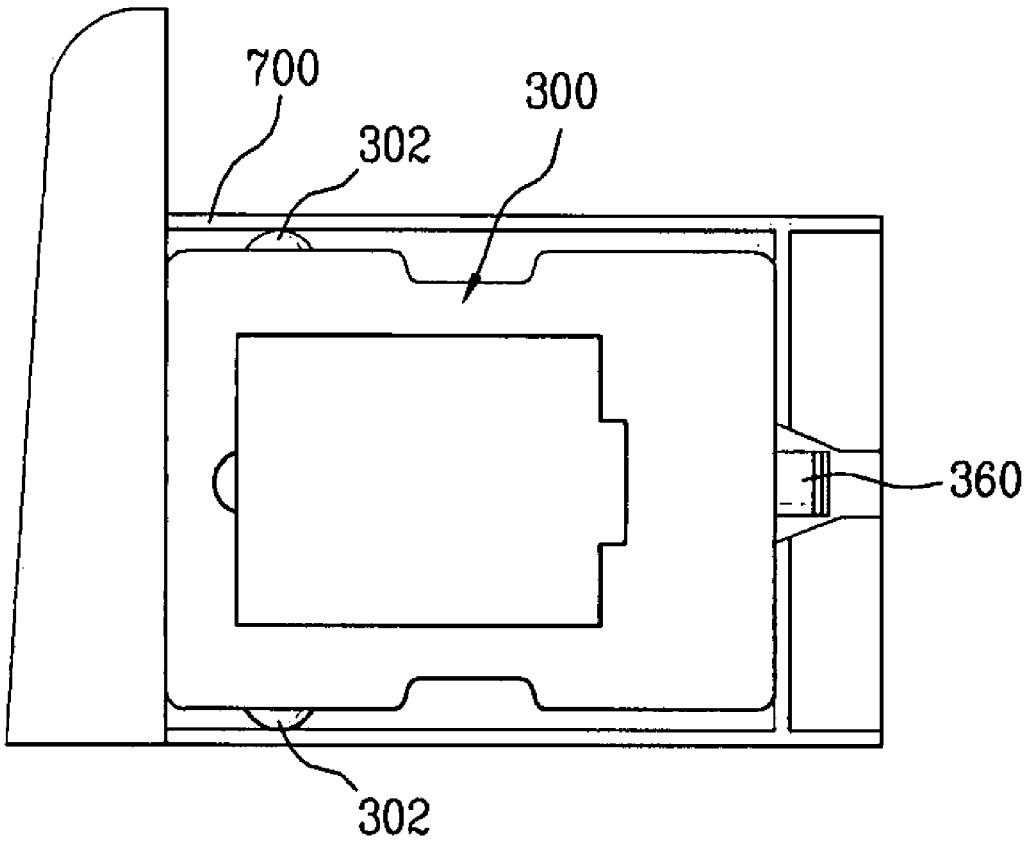
FIG. 10 is a plan view illustrating a state of mounting the water supply source with an exemplary fixing part to the container.
Figure 11:
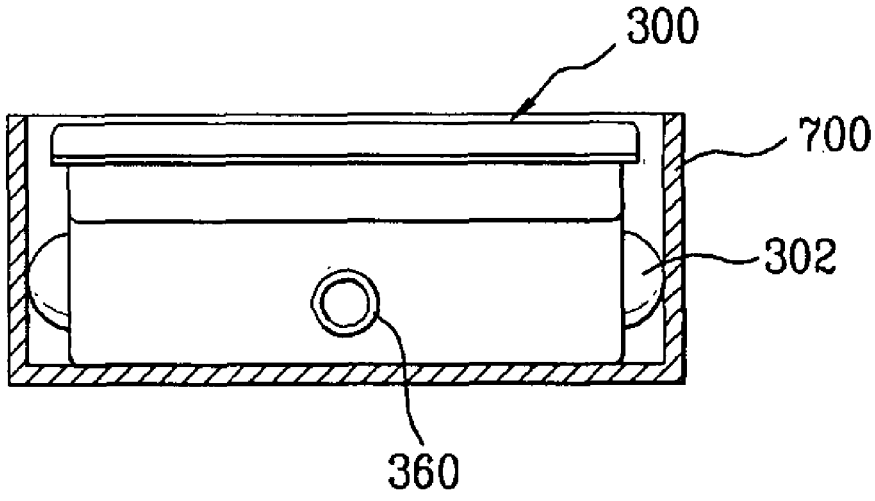
FIG. 11 is a partial sectional view when

FIG. 10 is a plan view illustrating a state of mounting the cartridge 300 with a first fixing part composing the fixing member in the drawer 700, and FIG. 11 is a partial sectional view when FIG. 10 is viewed from the front.

Referring to FIGS. 10 and 11, at least one first fixing part 302 is protrudingly formed at the outer surface of the cartridge 300, and has a shape capable of being point-contacted with the corresponding inner surface of the drawer 700. In other words, the first fixing part 302 of the present invention is not surface-contacted nor line-contacted with the inner surface of the drawer 700, but is formed so as to be point-contacted with the inner surface of the drawer 700. Since the first fixing part 302 is point-contacted with the inner surface of the drawer 700, the cartridge 300 can be fixed in the drawer 700, and also can be more easily mounted and demounted. This is because the point-contacting structure can decrease a frictional force by reducing a contact area between the cartridge 300 and the drawer 700 when compared to the surface-contacting or line-contacting structure.

As shown in the drawings, it is preferred that a pair of first fixing parts 302 are protrudingly formed in a semispherical shape at both the outer side surfaces of the cartridge 300. A top point of each of the semispherical-shaped first fixing parts 302 protruding from the cartridge 300 is point-contacted with the inner surface of the drawer 700. When the cartridge 300 is mounted in the drawer 700, both the side surfaces of the cartridge 300 are fixed by the first fixing parts 302, and the front and rear portions of the cartridge 300 are fixed while being closely contacted with the inner surface of the drawer 700. Further, when mounting the cartridge 300 in the drawer 700, a user can feel that the cartridge 300 is tightly fixed in the drawer 700 by the first fixing parts 302.

Although this embodiment has described that the fixing part is formed in a semispherical shape, the shape of the fixing part is not limited thereto. The fixing part can be formed in various shapes having a point-contacting structure.

It is preferred that the first fixing part 302 for fixing the cartridge 300 in the drawer 700 also performs a role of absorbing vibration transferred from the motor 70 (refer to FIG. 1) to the cartridge 300 via the cabinet 10 (refer to FIG. 1) and the drawer 700. A material of the first fixing part 302 is not certainly limited. The first fixing part 302 may be made of a rigid material capable of fixing the cartridge 300. Preferably, the first fixing part 302 is made of an elastic material capable of absorbing the vibration transferred from the drawer 700 to the cartridge 300.

The first fixing part 302 can be formed at any position capable of fixing the cartridge 300. Preferably, as shown in FIGS. 10 and 11, a pair of first fixing parts 302 are protrudingly formed at both the side surfaces of the cartridge 300. Accordingly, the cartridge 300 can be fixedly mounted in the drawer 700 by the first fixing parts 302 which are protrudingly formed at both the side surfaces of the cartridge 300. Further, if the first fixing part 302 is made of an elastic material, the first fixing part 302 can absorb the vibration transferred from the drawer 700 to both the side surfaces of the cartridge 300.

Figure 12:
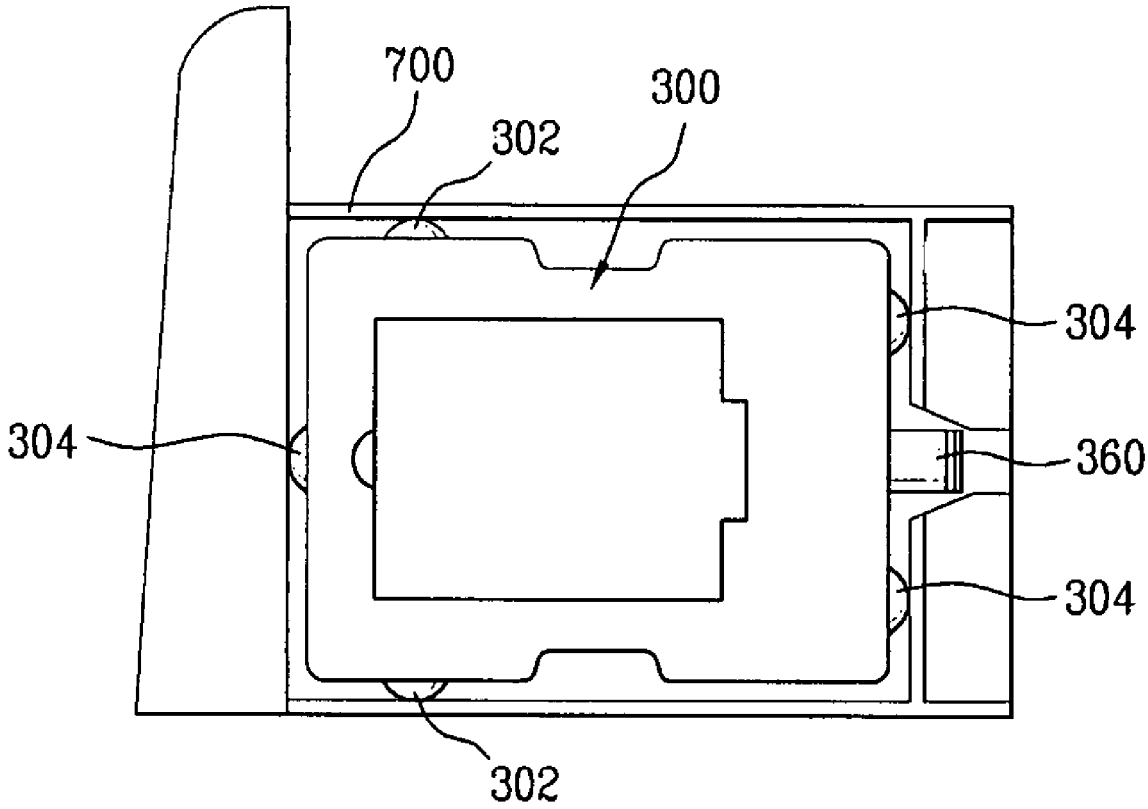
FIG. 12 is a plan view illustrating a state of mounting the water supply source with another exemplary fixing part to the container.

FIG. 12 is a plan view illustrating a state of mounting the cartridge with another exemplary fixing member in the drawer. In comparison with the previous embodiment, the fixing member of this embodiment further includes second fixing parts 304 which are formed at the rear and front surfaces of the cartridge 300. Such a feature of the fixing member of this embodiment distinguished over the previous embodiment will now be explained.

In the previous embodiment, the first fixing parts 302 formed at both the side surfaces of the cartridge 300 can fix both the side surfaces of the cartridge 300 and absorb the vibration transferred to both the side surfaces of the cartridge 300. However, the previous embodiment has a shortcoming that it is difficult to fix the cartridge 300 in a length direction, i.e., in a direction of the pump 400 (refer to FIG. 4) although the front and rear portions of the cartridge 300 are closely contacted with the inner surface of the drawer 700.

To cope with this problem, the fixing member of this embodiment further includes the second fixing parts 304 which are formed at the rear and front surfaces of the cartridge 300, so that the cartridge 300 can be more securely fixed in the all directions by the second fixing parts 304 as well as the first fixing parts 302. Similarly to the first fixing part 302, it is preferred that the second fixing part 304 is made of an elastic material, so as to absorb the vibration transferred from the drawer 700.

Although it is not illustrated in the drawings, the fixing member may be separately mounted from the guide unit shown in FIG. 9, or may be mounted together with the guide unit.

Hereinafter, the drawer guide 710 for guiding the movement of the drawer 700 will be described with reference to the drawings.

Figure 13:
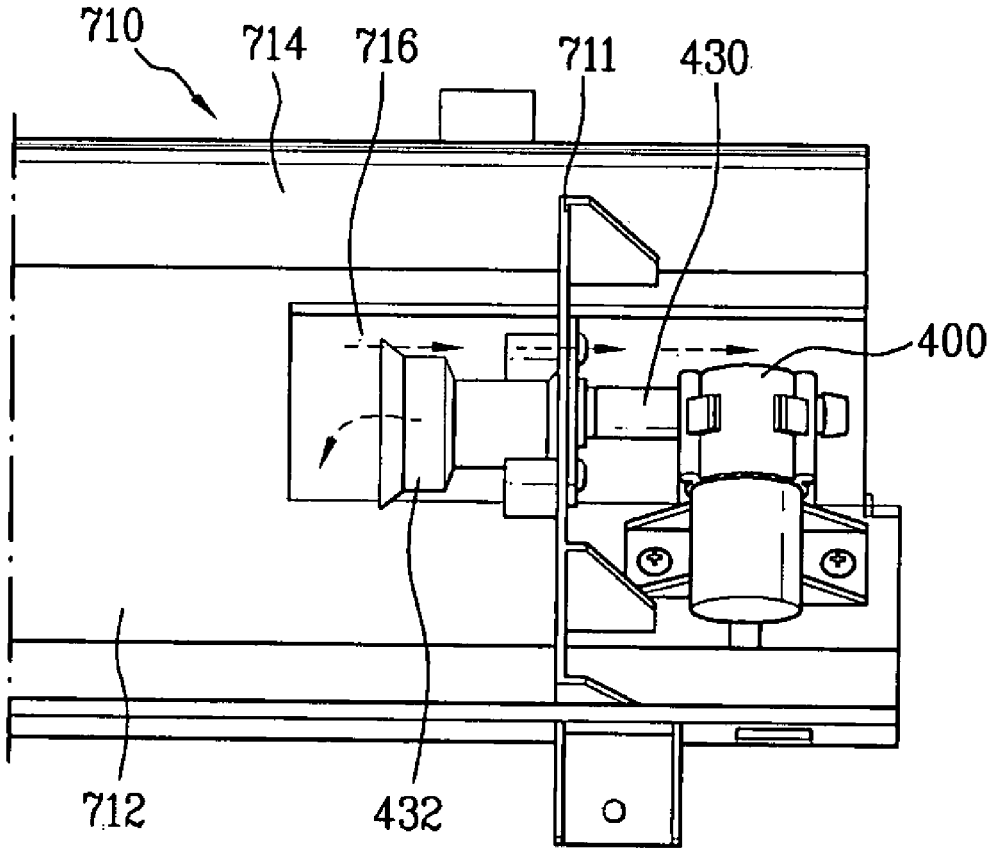
FIG. 13 is a perspective view illustrating an example of a water collecting part provided at a container guide for guiding the drawing and inserting of the container.
Figure 14:
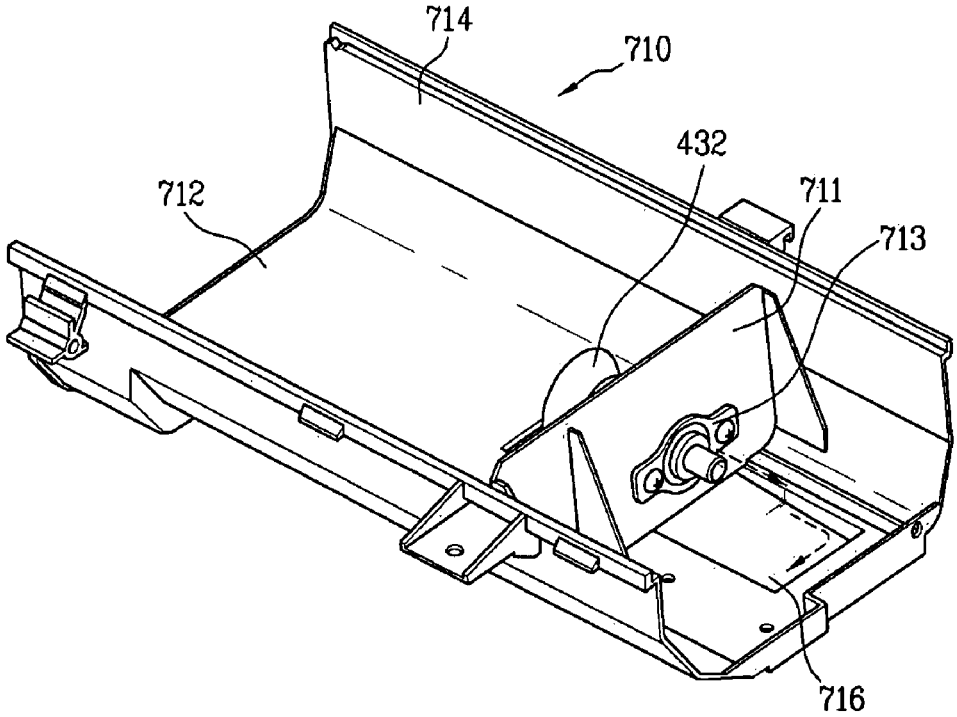
FIG. 14 is a perspective view when viewing the container guide shown in FIG. 13 from the rear.

FIG. 13 is a partial perspective view illustrating an example of the drawer guide 710, and FIG. 14 is a perspective view when FIG. 13 is viewed from the rear.

Referring to FIGS. 13 and 14, the upper portion and one side surface (at a direction of the front surface of the steam laundry dryer) of the drawer guide 710 are opened. Particularly, the drawer guide 710 includes a base 712, and a pair of side walls 714 extending vertically from both side surfaces of the base 712. The drawer guide 710 is mounted to the front surface of the steam laundry dryer, and the drawer 700 is inserted into or drawn out of a space defined by the base 712 and the side walls 714.

The pump 400, which is connected to the cartridge 300 (refer to FIG. 8), is mounted in the rear portion of the drawer guide 710. Therefore, when the drawer 700 is inserted into the laundry dryer, the opening/closing member 360 of the cartridge 300 is connected to the pump 400, and thus the water in the cartridge 300 is supplied into the steam generator 200 via the pump 400. When the cartridge 300 is connected to or disconnected from the pump 400, the opening/closing member 360 prevents the water leakage through the connecting portion between the cartridge 300 and the pump 400. But, such a water leakage preventing effect of the opening/closing member 360 is not perfect, and a small amount of water may leak. The leaking water moves along the base 712 of the drawer guide 710 when the drawer 700 moves, which has a bad effect on aesthetics.

To cope with this problem, the drawer guide 710 of this embodiment is provided with a water collecting part to collect water leaking from the connecting portion between the cartridge 300 and the pump 400, more particularly, from the connecting portion between the opening/closing member 360 and the pump 400. FIGS. 13 and 14 show an example of the water collecting part provided at the drawer guide 710.

Referring to FIGS. 13 and 14, a water collecting part 716 is configured as a concave part which is formed at the base 712 of the drawer guide 710. The concave part 716 is formed at the base 712, corresponding to a connecting portion between the opening/closing member 360 (refer to FIG. 4) of the water supply source 300 and a connecting member 432 connected to the inlet port 430 of the pump 400. Although water leaks from the connecting portion between the opening/closing member 360 of the water supply source 300 and the connecting member 432 of the pump 400, the leaking water is collected in the concave part 716 without moving on the upper surface of the base 712 of the drawer guide 710. The water collected in the concave part 716 evaporates as time passes.

Figure 15:
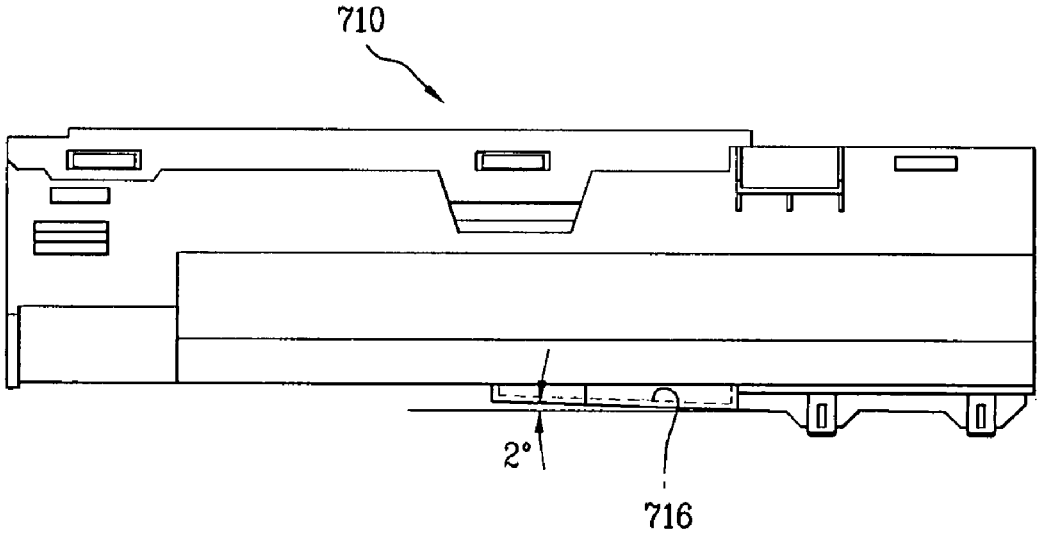
FIG. 15 is a side view of FIG. 14.

Even when the leaking water is collected in the concave part 716, it is preferred that the leaking water is invisible to a user. Accordingly, as shown in FIG. 15, the concave part 716 is inclined rearwardly of the drawer guide 710 at a predetermined angle, e.g., at 2 degrees. By the concave part 716 inclined rearwardly, the leaking water moves along the inclination of the concave part 716, and gathers in the rear portion of the concave part 716 adjacent to the rear surface of the drawer guide 710. Accordingly, even when a user draws the drawer 700 from the drawer guide 710, the leaking water gathering in the rear portion of the concave part 716 is invisible to a user.

As described above, the leaking water may be invisible to a user by the concave part 716 which is inclinedly formed. It is more preferred that the drawer guide 710 is provided with a shielding member to shield the rear portion of the concave part 716 so that even when the drawer 700 is drawn out, the rear portion of the concave part 716 is invisible from the front of the drawer guide 710. In this embodiment, as shown in FIG. 14, the shielding member is configured as a shielding plate 711.

The shielding plate 711 is provided at the drawer guide 710, adjacent to the pump 400. Particularly, when seen from the front of the drawer guide 710, the shielding plate 711 is mounted across the concave part 716 so as to shield the rear portion of the concave part 716. Accordingly, even when the drawer 700 is drawn out, the rear portion of the concave part 716 is invisible to a user by the shielding plate 711.

The shielding plate 711 is formed with a hole (not shown), and a supporting bracket 713 is mounted around the hole. The inlet port 430 of the pump 400 and the connecting member 432 are connected to each other by the hole and the supporting bracket 713. When water leaks between the opening/closing member 360 and the connecting member 432, the leaking water drops on the concave part 716. The water dropping on the concave part 716 flows below the shielding plate 711 by the inclination of the concave part 716, and gathers in the rear portion of the concave part 716.

Figure 16:
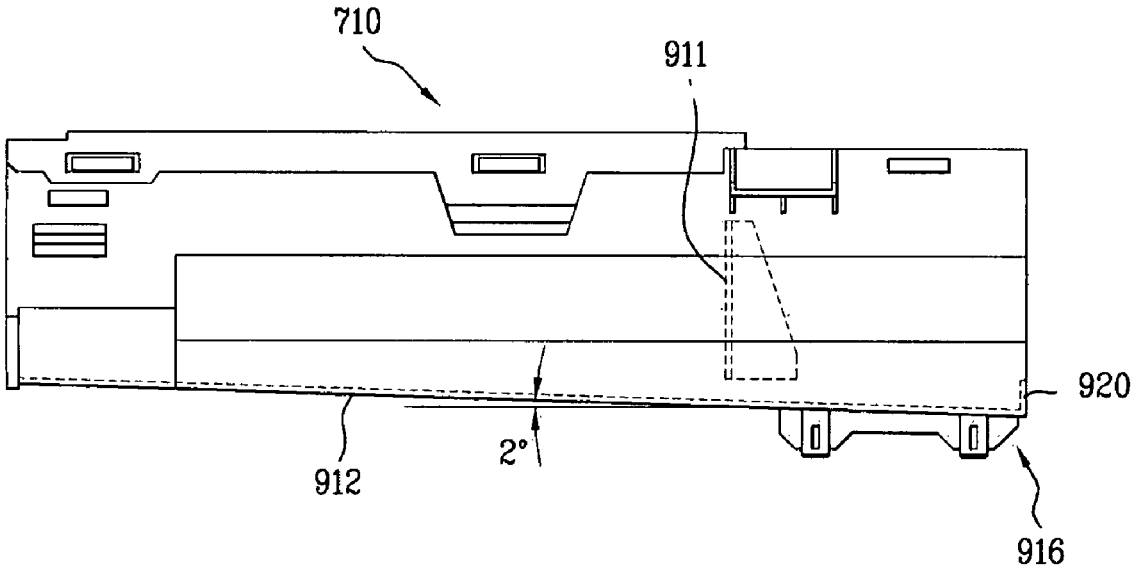
FIG. 16 is a side view illustrating another example of a water collecting part provided at the container guide.

FIG. 16 is a side view illustrating another example of the water collecting part.

Referring to FIG. 16, a water collecting part 916 of this embodiment is configured as a base 912 which is inclined rearwardly. In other words, the base 912 of the drawer guide 710 is inclined rearwardly overall at a predetermined angle, e.g., at 2 degrees. Accordingly, the water leaking between the opening/closing member 360 and the connecting member 432 flows along the inclined base 912, and gathers in the rear portion of the drawer guide 710. An overflow preventing wall 920 is provided at the rear end portion of the drawer guide 710 so as to prevent the collected water from overflowing the drawer guide 710. The water flowing to the rear portion of the drawer guide 710 does not overflow outside by the overflow preventing wall 920.

It is also preferred that the drawer guide 710 of this embodiment is provided with a shielding plate 911. The shielding plate 911 is provided at a predetermined portion of the drawer guide 710 to shield the rear portion of the inclined base 912 to be invisible. Differently from the embodiment shown in FIG. 13, the shielding plate 911 of this embodiment is disposed at a predetermined gap from the base 912. This is to enable the leaking water to flow through the gap between the shielding plate 911 and the base 912 and gather in the rear portion of the base 912. Although it is not illustrated in the drawings, the shielding plate 911 may be mounted to be closely contacted with the base 912. In such a case, so as for the water to flow to the rear portion of the drawer guide 710, the shielding plate 911 is formed with at least one flow hole in contact with the base 912.

Hereinafter, a process of supplying water into the cartridge 300 will be explained with reference to FIG. 8.

If a user draws out the drawer 700, the cartridge 300 is also drawn out therewith. Then, the user dismantles the cartridge 300 from the drawer 700. Water is supplied into the cartridge 300 through the water inlet 322 so that the cartridge 300 is filled with the water. The cartridge 300 filled with the water is mounted again in the drawer 700, and the drawer 700 is pushed in. The opening/closing member 360 of the cartridge 300 is automatically connected to the pump 400, and the water in the cartridge 300 flows to the pump 400.

When the operation of the steam laundry dryer is completed, the cartridge 300 can be removed from the drawer 700. Since the cartridge 300 is composed of the upper housing 320 and the lower housing 310, it is easy to clean the removed cartridge 300.

Experimental results by this inventor show that the steam laundry dryer according to the present invention has an effect of removing and preventing wrinkles of laundry, although there is a difference according to the kinds of laundry, e.g., the kinds of cloths, hygroscopic properties, and the like. The object to be dried by the steam laundry dryer is generally the laundry dehydrated by a washing machine, however this is not restricted thereto. For example, the steam laundry dryer according to the present invention can remove wrinkles of the clothes that a user has worn for one day or more, i.e., the already dried clothes having few wrinkles. In other words, the steam laundry dryer according to the present invention also can be used as a kind of wrinkle-removing apparatus.

The steam laundry dryer according to the present invention may have the following advantageous effects.

First, wrinkles or crumples generated on the dried laundry can be effectively prevented or removed. Further, sterilization and deodorization of the dried laundry can be achieved.

Second, wrinkles or crumples of the clothes that are in a dried state, can be effectively removed without additional ironing.

Third, although water leakage occurs in the steam laundry dryer, the leaking water is shielded to be invisible to a user.

Fourth, vibration of the water supply source during the operation of the steam laundry dryer can be prevented, thereby remarkably decreasing noise.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A laundry machine comprising:

a drum rotatably mounted in a cabinet;

a hot air heater to heat air to supply hot air into the drum;

a steam generator to supply steam into the drum;

a water supply source to supply water into the steam generator;

a container drawably mounted in a portion of the cabinet, the water supply source being detachably mounted in the container;

a container guide provided at a portion of the cabinet to guide drawing and inserting of the container; and a pump to supply water in the water supply source into the steam generator, wherein the water supply source is selectively connected to the pump;

wherein the container guide includes a water collecting part to collect water leaking from a connecting portion between the water supply source and the pump.

2. The laundry machine according to claim 1, further comprising:

a guide unit to guide the water supply source to be mounted in the container.

3. The laundry machine according to claim 2, wherein the guide unit includes a guide part provided on at least one of a front portion and a rear portion of the container, and wherein the guide part is selectively contacted with the water supply source.

4. The laundry machine according to claim 3, wherein the guide part includes a first guide part and a second guide part respectively provided on the front portion and the rear portion of the container, and wherein the first guide part and the second guide part are spaced at a distance from each other, corresponding to a length of the water supply source.

5. The laundry machine according to claim 4, wherein the first guide part is configured as a protruding part protrudingly formed inwardly from the front portion of the container.

6. The laundry machine according to claim 4, wherein the second guide part is configured as at least one guide member formed at the rear portion of the container.

7. The laundry machine according to claim 6, wherein the guide member has an upper surface inclined inwardly of the container.

8. The laundry machine according to claim 4, wherein the guide unit further includes a third guide part and a fourth guide part respectively provided on both inner side surfaces of the container, and wherein the third guide part and the fourth guide part are selectively contacted with both side surfaces of the water supply source.

9. The laundry machine according to claim 8, wherein the third guide part and the fourth guide part are spaced at a distance from each other, corresponding to a width of the water supply source.

10. The laundry machine according to claim 8, wherein the third guide part and the fourth guide part are configured as guide members protrudingly formed at both the inner side surfaces of the container.

11. The laundry machine according to claim 1, further comprising:

a position determining unit to determine a position of the water supply source mounted in the container.

12. The laundry machine according to claim 11, wherein the position determining unit includes at least one coupling recess formed at the container, and at least one coupling protrusion formed at the water supply source to be selectively inserted into the coupling recess.

13. The laundry machine according to claim 1, further comprising:

a fixing member to fix the water supply source mounted in the container.

14. The laundry machine according to claim 13, wherein the fixing member is formed at any of the water supply source and the container, and is point-contacted with the other one of the water supply source and the container.

15. The laundry machine according to claim 14, wherein the fixing member has a semispherical shape.

16. The laundry machine according to claim 14, wherein the fixing member is protrudingly formed at a portion of the water supply source, and is point-contacted with an inner surface of the container.

17. The laundry machine according to claim 16, wherein the fixing member includes a pair of first fixing parts protrudingly formed at both side surfaces of the water supply source.

18. The laundry machine according to claim 17, wherein the fixing member further includes second fixing parts protrudingly formed at a rear surface and a front surface of the water supply source.

19. The laundry machine according to claim 14, wherein the fixing member is made of an elastic material to absorb vibration transferred to the water supply source from the container.

20. The laundry machine according to claim 1, wherein the container guide includes a base, and a pair of side walls extending vertically from the base, and wherein the water collecting part is configured as a concave part formed at the base.

21. The laundry machine according to claim 20, wherein the concave part is formed at the base corresponding to the connecting portion between the pump and the water supply source.

22. The laundry machine according to claim 20, wherein the concave part is inclined rearwardly of the base.

23. The laundry machine according to claim 22, further comprising:

a shielding member to shield a rear portion of the inclined concave part so as to be invisible from a front of the container guide.

24. The laundry machine according to claim 23, wherein the shielding member is configured as a shielding plate mounted to the container guide across and over the concave part.

25. The laundry machine according to claim 24, wherein the water supply source and the pump are connected to each other through the shielding plate.

26. The laundry machine according to claim 1, wherein the container guide includes a base, and a pair of side walls extending vertically from the base, and wherein the water collecting part is configured as the base inclined rearwardly of the container guide.

27. The laundry machine according to claim 26, further comprising:

a shielding member to shield a rear portion of the inclined base so as to be invisible from a front of the container guide.

28. The laundry machine according to claim 27, wherein the shielding member is configured as a shielding plate mounted to the container guide across the base.

29. The laundry machine according to claim 28, wherein the shielding plate is disposed at a predetermined gap from the base.

* * * * *